US005492000A

United States Patent [19]

Main

[11] Patent Number: 5,492,000

[45] Date of Patent: Feb. 20, 1996

[54] ROTARY VALVE CONTROLLED APPARATUS FOR STRIPPING CANS FROM BODYMAKING RAM

[75] Inventor: Ralph M. Main, San Pedro, Calif.

[73] Assignee: Sequa Corporation, Hackensack, N.J.

[21] Appl. No.: 236,466

[22] Filed: May 2, 1994

[51] Int. Cl.[6] ..... B21D 45/08

[52] U.S. Cl. ..... 72/345; 251/304

[58] Field of Search ..... 72/345; 251/304; 137/625.21

[56] References Cited

U.S. PATENT DOCUMENTS

| | | | |
|---|---|---|---|
| 1,509,163 | 9/1924 | Minge | 251/304 |
| 2,578,160 | 12/1951 | Van Der Werff | 251/85 |
| 2,593,733 | 4/1952 | Davies | 251/105 |
| 2,964,061 | 12/1960 | Rawson et al. | 137/627 |
| 2,994,344 | 8/1961 | Kerley | 251/304 |
| 2,996,083 | 8/1961 | Huska | 137/625.11 |
| 3,040,777 | 6/1962 | Carson et al. | 137/625.15 |
| 3,131,605 | 5/1964 | La Borde | 91/198 |
| 3,198,004 | 8/1965 | Roberts et al. | 73/45.1 |
| 3,635,069 | 1/1972 | Eickenhorst | 72/345 |
| 3,713,462 | 1/1973 | Bushee | 137/625.21 |
| 4,007,620 | 2/1977 | Urban | 72/345 |
| 4,316,707 | 2/1982 | Hansen et al. | 418/60 |
| 4,509,555 | 4/1985 | Stirbis | 137/625.11 |
| 5,183,145 | 2/1993 | Williams et al. | 198/441 |

*Primary Examiner*—Lowell A. Larson

*Attorney, Agent, or Firm*—Mitchell D. Bittman; Jerome M. Berliner

[57] ABSTRACT

A press for forming the relatively long cylindrical body of a so-called two piece beverage can utilizes a horizontally reciprocating ram to drive a relatively short cup through a circular die pack. Compressed air applied through a rotary valve is utilized to strip the bodies from the ram. Such valve includes a continuously rotating rotor that is mechanically connected to the drive for the ram such that for each rotor revolution the ram moves through a complete cycle consisting of a forward working stroke followed by a rearward return stroke. The rotor is constructed of two disks that abut face to face. A rotor drive shaft extends through the center of the rotor and the angular position of the disks relative to each other is adjustable to adjust the portion of each rotor revolution during which compressed air is applied for stripping. Each disk is provided with an arcuate aperture and the extent to which these apertures overlap determines how long compressed air is applied for stripping. The angular position of the rotor on the drive shaft determines when compressed air is applied for stripping.

14 Claims, 5 Drawing Sheets

Fig. 6.
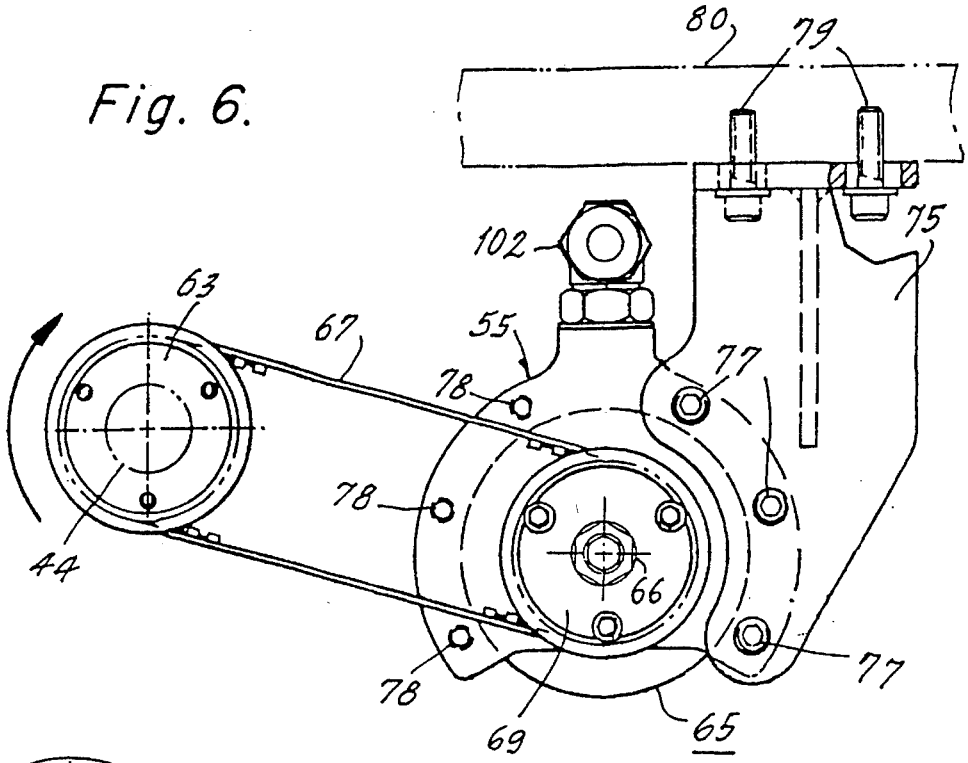
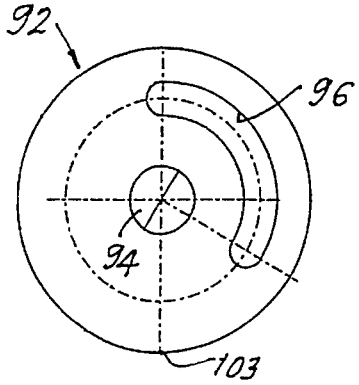
Fig. 11.
Fig. 10.
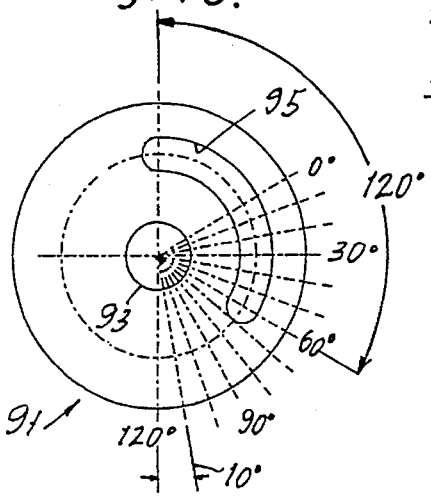
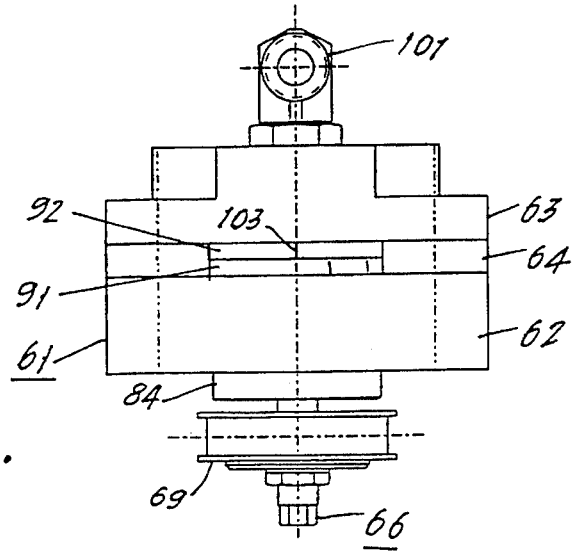
Fig. 9.

ROTARY VALVE CONTROLLED APPARATUS FOR STRIPPING CANS FROM BODYMAKING RAM

BACKGROUND OF THE INVENTION

This invention relates generally to can bodymaking equipment and in particular relates to stripping of newly formed can bodies from the ram that drives the can forming blank through the forming dies.

In the art of bodymaking apparatus for transforming blanks in the form of relatively short metal cups into elongated bodies for two piece cans, the bodies are stripped from the ram by mechanical devices that engage the edge at the open end of the body and/or by utilizing compressed air that enters the can body through one or more outlets at the downstream end of the ram. Mechanical strippers by themselves have been found to be unreliable, especially at high production speeds. Problems have also arisen at high production speeds when application of compressed air for stripping is under the control of valves that are mounted in the ram at its downstream end to be actuated by sensing that formation of the can body base profile has been completed. The prior art has also controlled application of compressed air for stripping by utilizing solenoid actuated valves that are mounted on the machine frame in a stationary position. Because solenoid valves are relatively slow to recycle, it is difficult to meet high cycle rate requirements. Air-line supply contaminates add to this problem. While solenoid valves can be shielded from much machine vibration, the total effect of slow recycling and contaminates is that solenoid valve operation becomes erratic at high cycle rates, making it difficult to maintain, adjust and/or control coordination between the position of the ram and the application of compressed air for stripping.

Examples of can body strippers are disclosed in U.S. Pat. No. 3,524,338 issued Aug. 18, 1970 to J. S. Bozek for A Stripping Punch; U.S. Pat. No. 3,572,271 issued Mar. 23, 1971 to E. C. Fraze for Fabrication Of Can Bodies With Integral Bottom Walls; U.S. Pat. No. 3,771,344 issued Nov. 13, 1973 to G. W. Wright for Apparatus For Stripping Container Bodies From Metal Working Punches; and U.S. Pat. No. 5,056,350 issued Oct. 15, 1991 to B. A. Moen, W. R. Williams, B. E. Johansson and L. W. Mayer for Apparatus And Method For Stripping A Workpiece From Supporting Device.

SUMMARY OF THE INVENTION

To overcome the foregoing problems of the prior art, compressed air stripping of cam bodies from the ram of the bodymaker is controlled by utilizing a mechanically operated rotary control valve having a rotor that rotates continuously in a single direction and within each rotation of the rotor its speed is essentially uniform. This is accomplished by driving the control valve rotor from the same shaft that provides the input power to the mechanism that reciprocates the ram. The rotor provides a passageway between input and output ports of the control valve during a selected portion of each rotor revolution and when this connection is made the control valve is said to be open. When open, the valve provides a passage through which compressed air is applied through the interior of the ram into the interior of the newly formed can body, whereby the latter is stripped from the ram by being prevented from moving rearward with the ram as the latter moves in its return stroke.

As will hereinafter be seen, the rotor of the control valve is constructed of a pair of disks that are assembled on the rotating valve shaft. These disks are angularly adjustable relative to one another to adjust the period during which the control valve is open. The angular position of the disk assembly is adjustable relative to the timing pulley through which the valve shaft is driven to adjust phasing between the control valve and the ram of the bodymaker.

Accordingly, a primary object of the instant invention is to provide a can bodymaker having improved compressed air stripping apparatus for removing can bodies from the bodymaker ram.

Another object is to provide a compressed air stripping device of this type that is reliable at high production speed, requires reduced maintenance and has a long operating life.

Still another object is to provide a compressed air stripping device of this type that is readily adjustable to control the portion of each cycle during which compressed air is applied for stripping of a can body.

A further object is to provide a compressed air stripping device of this type constructed so that adjustment of phasing between valve operation and ram position is facilitated.

Other features and advantages of the present invention will become apparent from the following description of the invention which refers to the accompanying drawings.

BRIEF DESCRIPTION OF THE DRAWINGS

In FIG. 2 the ram of the bodymaker is in its most rearward position after having completed its return stroke and in FIG. 3 the ram is in its most forward position after having completed its working stroke.

FIG. 6 is a rear elevation showing the mounting of the continuously rotating can stripping control valve.

FIG. 9 is a side elevation of the control valve looking in the direction of arrows 9—9 in FIG. 7.

FIG. 10 is a front elevation of the phase disk of the rotor for the control valve.

FIG. 11 is a front elevation of the index disk for the rotor of the control valve.

DETAILED DESCRIPTION OF THE INVENTION

Figure 1:
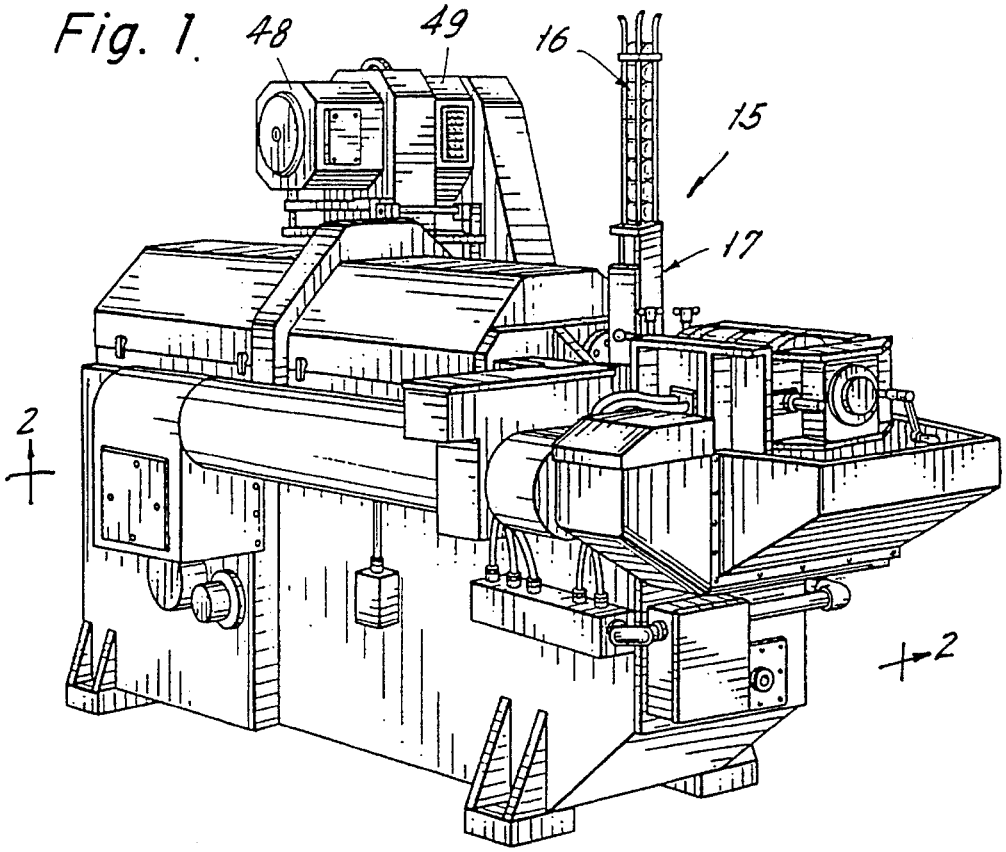
FIG. 1 is a perspective of a can bodymaker that includes body stripping apparatus constructed in accordance with teachings of the instant invention.
Figure 4:
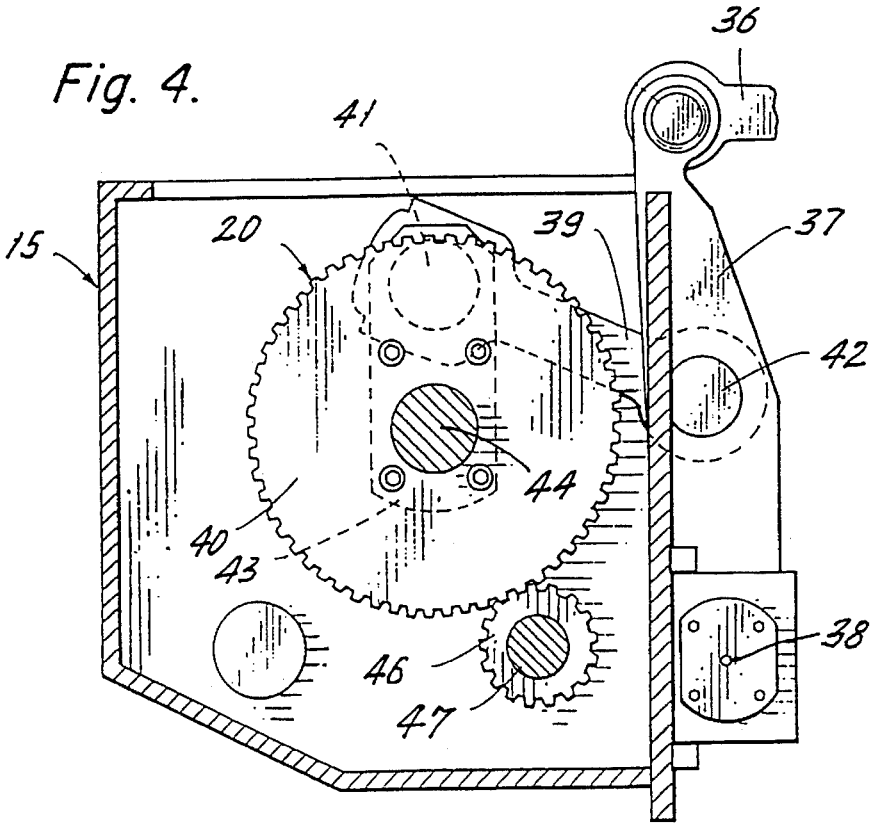
FIG. 4 is a fragmentary side elevation of the mechanism for reciprocating the ram.
Figure 2:
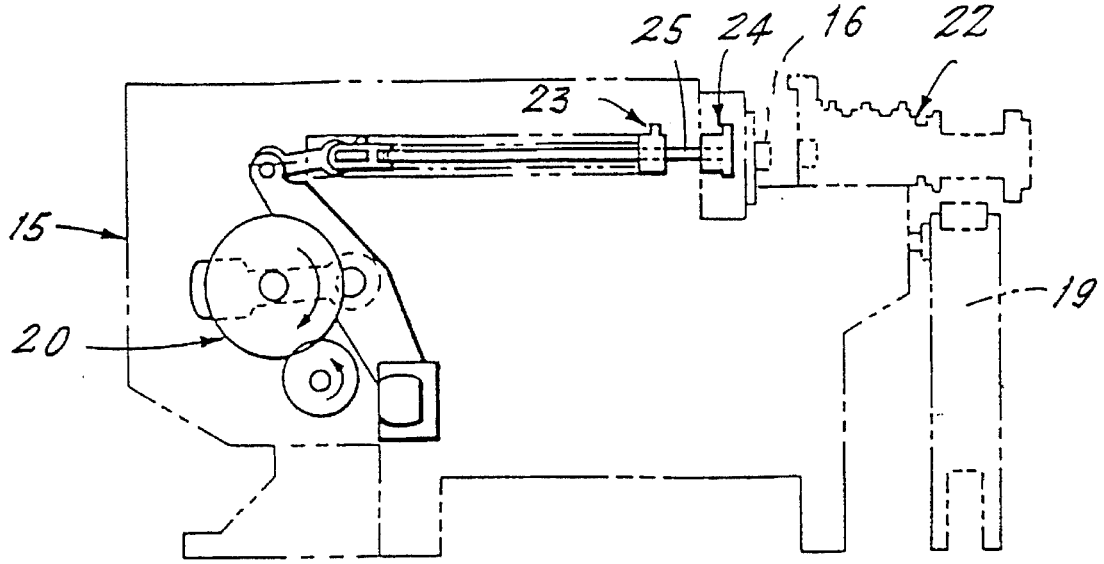
FIGS. 2 and 3 are schematics of the bodymaker of FIG. 1 looking in the direction of arrows 2—2 in FIG. 1.
Figure 3:
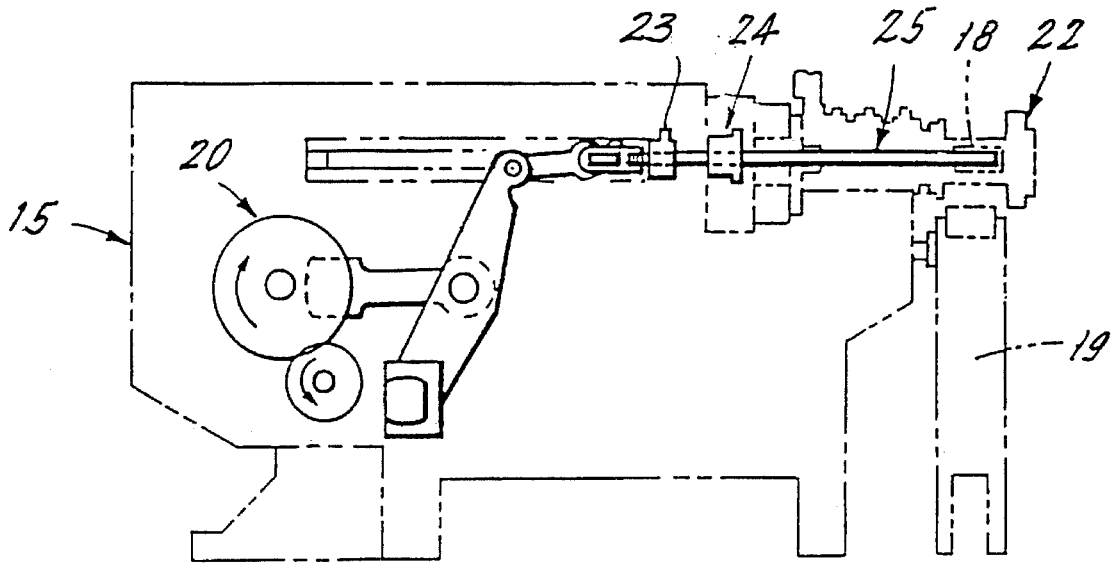

Now referring to the Figures and more particularly to FIGS. 1 through 5 which, for the most part, are also found in U.S. Pat. No. 4,173,138 which issued Nov. 6, 1979 to R. M. Main and E. Paramonoff for a Can Bodymaker Having Improved Ram Support and Drive. The teachings of U.S. Pat. No. 4,173,138 are incorporated herein by reference.

In a manner known to the art of making metal beverage containers, can bodymaker 15 transforms blanks in the form of shallow metal cups 16 (FIG. 2) delivered by infeed device 17 into elongated can bodies 18 (FIG. 3) which drop downwardly and are received by outfeed device 19. This is accomplished by utilizing reciprocating drive mechanism 20 to move horizontally disposed hollow ram 25 longitudinally forward in a working stroke from its rearmost position of FIG. 2 to its most forward position of FIG. 3, at which point movement of ram 25 is reversed and ram 25 moves in a return stroke to its most rearward position of FIG. 2. During its forward working stroke, ram 25 drives cup 16 through ring die assembly 22 which reduces the diameter and sidewall thickness of blank 16 while elongating same to form can body 18. During the forward and rearward movement, ram 25 is supported by spaced stationary bearing sleeves 23 and 24.

Figure 5:
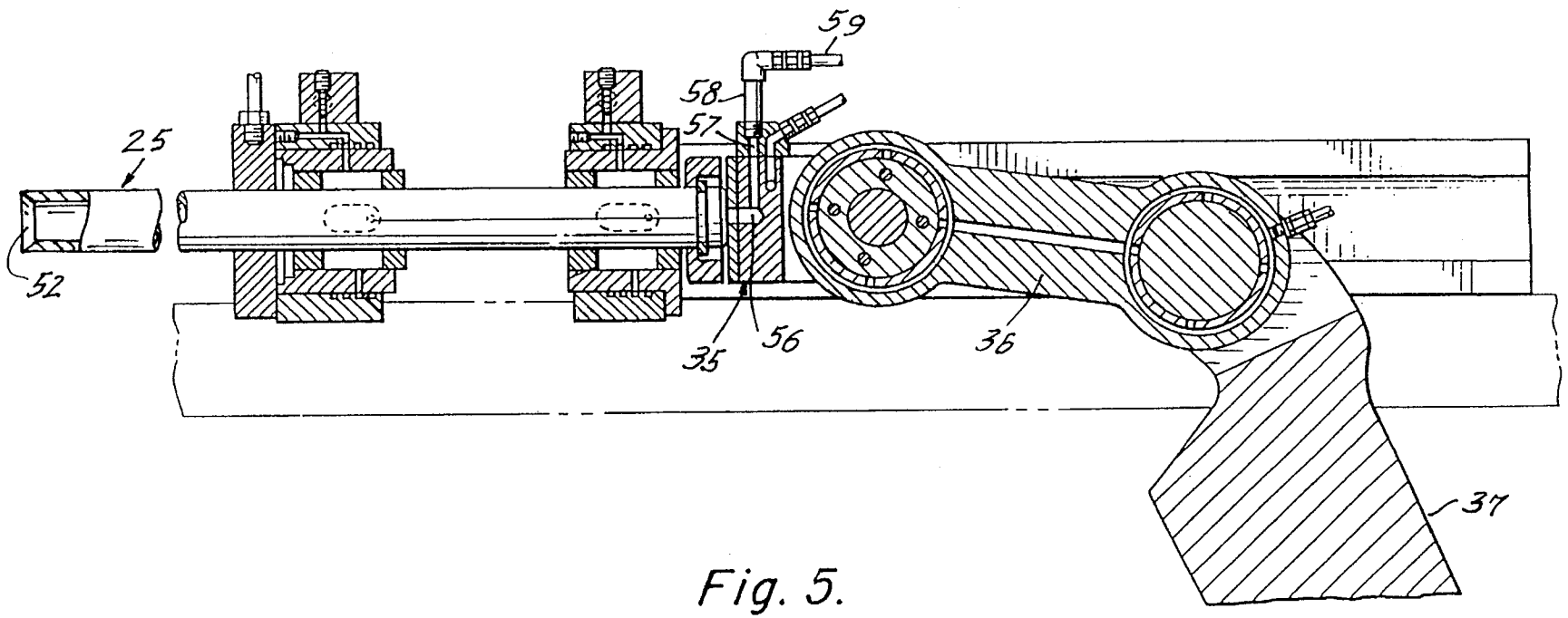
FIG. 5 is a fragmentary partially sectioned side elevation of the ram and its connection to the driving mechanism.

Driving mechanism 20 is connected to the rear of ram 25 by bearing slide assembly 35 (FIG. 5). The latter is pivotally connected to the front end of drive rod 36 whose rear end is pivotally connected to the free upper end of drive arm 37, and the lower end of drive arm 37 is fixed to the machine frame at pivot center 38, so as to oscillate thereabout. Arm 37 is driven by transfer arm 39, one end of which is connected by pivot 41 to crank arm 43 and the other end of which is pivotally connected at 42 to drive arm 37 at a point intermediate the ends thereof. Pivot 41 is at the free end of crank arm 43 which extends radially from main shaft 44 and is keyed thereto for rotation thereby. Bull gear 40 is also keyed to main shaft 44 for rotation therewith, and is in mesh with pinion 46 that is keyed to drive shaft 47 which is driven by electric drive motor 48 through variable speed drive 49.

To assure that can body 18 does not move rearward with ram 25, compressed air is applied to the interior of ram 25 through appropriate passageways of connecting means 35 at the rear of ram 25 and this compressed air exits through front opening 52 (FIG. 5) of ram 25 to the inside of can body 18 so as to strip same from the front end of ram 25. For this purpose connecting means 35 is provided with a passage having connected axial 56 and transverse 57 sections, with the latter having short pipe 58 extending therefrom. Flexible hose 59 extending from pipe 58 is operatively connected to can stripping control valve 55 which shall now be described with particular reference to FIGS. 6 through 11.

Valve 55 includes housing 61 consisting of rear section 62, front section 63, and spacer 64 interposed between sections 62 and 63 to provide a cavity wherein most of rotor 65 is disposed. Main elements 62–64 of housing 61 are secured together by six bolts 76 that extend through clearance apertures adjacent the periphery of elements 63 and 64, and are received by threaded apertures entered at the front of rear housing element 62. Threaded apertures 78 enterable at the rear of rear housing element 62 are adapted to receive mounting bolts 77. There are six apertures 78 and, as seen in FIG. 6, for securing valve 55 to mounting bracket 75 only three bolts 77 are required. Two additional bolts 79 secure bracket 75 to fixed frame 80 that also supports ram 25 and the other operating elements of bodymaker 15.

Valve shaft 66 rotatably supports rotor 65, and is driven in synchronism with reciprocation of ram 25 by timing belt 67. That is, for each cycle or revolution of shaft 66, ram 25 is driven through one complete cycle consisting of a forward working stroke and a rearward return stroke. Timing belt 67 is driven by pulley 63 and drives pulley 69. Pulley 63 is keyed to main shaft 44 and pulley 69 is keyed to valve shaft 66, being disposed behind rear housing section 62. Shaft 66 extends through and is supported by bearing sections 71, 72 that are separated by ring spacer 73.

Bearing sections 71, 72 (FIG. 8) are closely fitted in aperture 74 that extends through rear housing section 62. Integrally formed on shaft 66 and protruding radially therefrom are wide shoulder 81 and narrow shoulder 82. The latter extends into aperture 74 through its front end and engages bearing section 71. Bearing section 72 is engaged by ring 83 that is disposed on the front surface of cap 84 and extends axially therefrom. Cap 84 is provided with a central aperture through which shaft 66 extends and is disposed between rear housing section 62 and pulley 69, being held against the rear surface of housing section 62 by a plurality of bolts 86.

Control valve 55 is also provided with inlet port 87 formed by a passage through front housing section 63, which passage is parallel to the rotational axis of shaft 66. Valve 55 is also provided with outlet port 88 in the form of an L-shaped passage that extends through rear housing section 62 from its forward surface to its edge. The rear or exit end of inlet port 87 is axially aligned with the inlet end of exit port 88.

Figure 8:
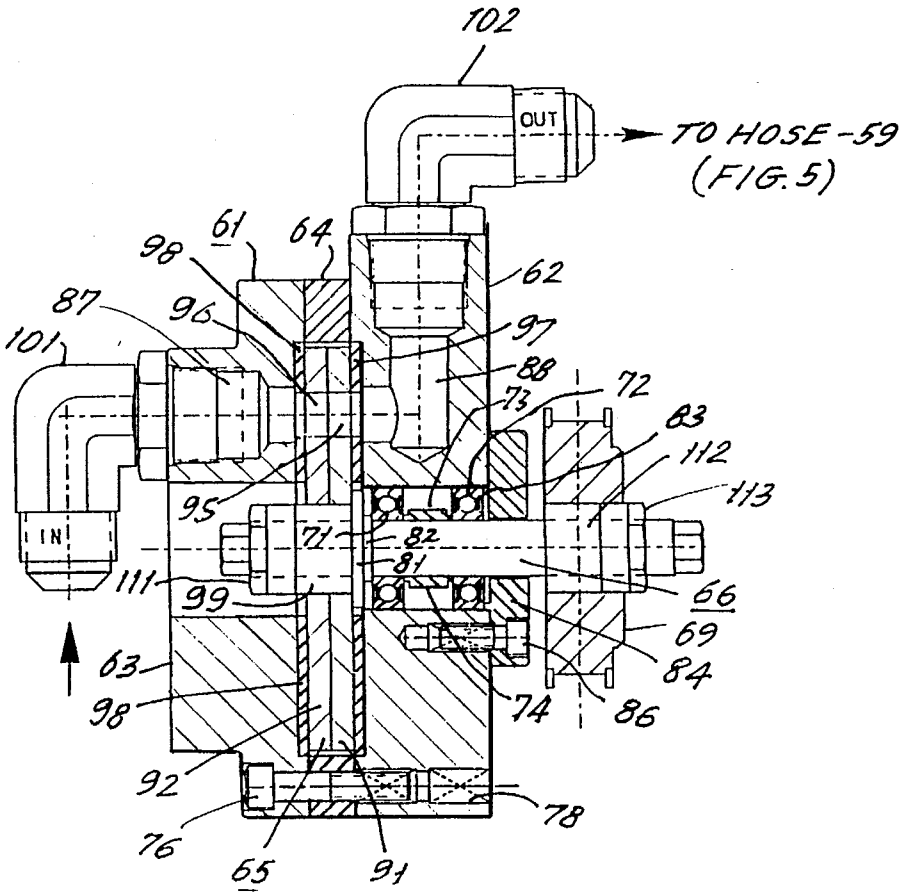
FIG. 8 is a cross-section taken through line 8—8 in FIG. 7 looking in the direction of arrows 8—8.
Figure 7:
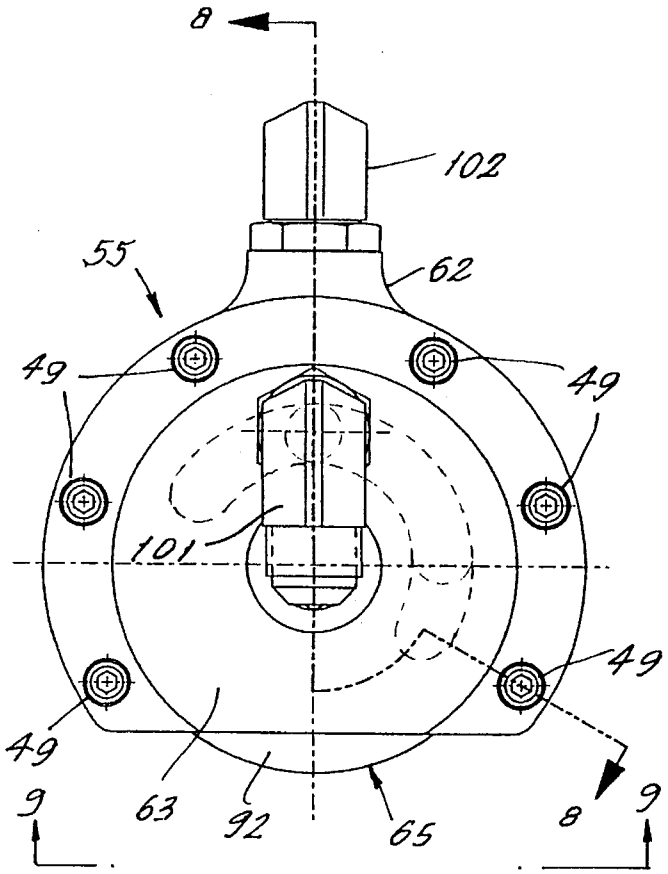
FIG. 7 is a front elevation of the can stripping control valve.

Rotor 65 is an assembly consisting of phase disk 91 (FIG. 10) and index disk 92 (FIG. 11). As seen in FIG. 8, the front surface of disk 91 abuts the rear surface of disk 92. The respective rotor forming disks 91, 92 are provided with central circular apertures 93, 94 and arcuate apertures 95, 96. The latter are formed about the center of the respective disks 91, 92 and extend for 120°. Disks 91, 92 are of the same diameter, central apertures 93, 94 are of the same diameter, and arcuate apertures 95, 96 are of the same size (both length and width) and are located the same distance from the disk centers. Thin friction plates 97, 98 are secured within shallow recesses of the respective housing sections 62, 63. The front face of friction plate 97 is adjacent the rear face of phase disk 91 and the rear face of friction plate 98 is adjacent the front face of index disk 92. Friction plates 97, 98 are provided with apertures which are in alignment with the inlet and outlet ports 87, 88 of valve 55, and are also provided with apertures through which shaft 66 extends.

Expandable element 99 disposed within central aperture 93, 94 of rotor 65 and surrounding shaft 66, constitutes an adjustable coupling that keys rotor 65 to shaft 66 for rotation by the latter. Contraction of coupling 99 permits the relative angular positions between rotor disks 91, 92 to be adjusted. In a manner well known to the art coupling 99 is expanded by tightening nut 111 that is mounted on shaft 66 adjacent the front end thereof. This tightening of nut 111 squeezes coupling 99 against shoulder 81 causing coupling 99 to expand and firmly engage both shaft 66 and rotor 65. The centers of arcuate apertures 95, 96 are the same distance from the center of shaft 66 as are the outlet end of inlet port 87 and the inlet end of outlet port 88, so that for selected portions during each revolution of rotor 65 arcuate aperture 95 communicates with outlet port 88 and arcuate aperture 96 communicates with inlet port 87.

Elbow fitting 101 is secured to front housing section 63 and is used to connect inlet port 87 to a source of compressed air, while elbow fitting 102 is secured to rear housing section 62 for connecting outlet port 88 to flexible hose 59 which is connected to the interior of ram 25.

Valve 55 is said to be open when there is communication between inlet and outlet ports 87, 88. For 240° of rotation for rotor 65 inlet port 87 is closed by rotor disk 92 in that the exit of inlet port 87 and arcuate aperture 96 are out of alignment. Similarly, for 240° of rotation for rotor 65 outlet port 88 is closed in that the inlet thereto is out of alignment with arcuate aperture 95 of phase disk 91. In FIG. 8 control valve 55 is shown open in that arcuate aperture 96 is aligned with the exit end of inlet port 87 and arcuate aperture 95 is aligned with the entrance end of exit port 88, and at the same time there is at least partial overlapping between arcuate apertures 95, 96.

The interval during each revolution of rotor 65 during which control 55 is open depends upon the relative angular positions between rotor disks 91, 92. This condition is indicated by the position of index mark 103 on the edge of index disk 92 relative to the angle indicating indicia along the edge of phase disk 91. As seen in FIGS. 6, 7, 10 and 11, a peripheral portion of rotor 65 extends outside of housing 61. This facilitates adjusting the relative angular position between rotor disks 91, 92. By positioning index mark 103 outside of housing 61 (FIG. 9), the indicia on phase disk 91 relative to index mark 103 is observable.

While body maker 15 is operating, during each revolution of rotor 65 the position of ram 25 when control valve 55 first opens is, preferably, just as ram 25 reaches the end of its working stroke (FIG. 3) and is about to reverse direction to move rearward in its return stroke. With control valve 55 open, compressed air fed thereto is applied through the hollow interior of ram 25, and appears at front exit 52 thereof to assure that the newly produced can body 18 does not move rearward together with ram 25. Instead, can body 18 drops into outlet 19. The phasing between control valve rotor 65 and ram 25 is adjusted by setting the angular position of rotor 65 relative to that of pulley 69 on valve shaft 66. This may be accomplished by operating nut 113 at the rear of shaft 66 to relax coupling ring 112 that keys pulley 69 to shaft 66. With coupling ring 112 relaxed shaft 66 and rotor elements 91, 92 may be rotated relative to pulley 69.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A bodymaker for transforming metal cups into elongated can bodies, said bodymaker including:

an elongated ram supported for horizontal longitudinal movement along a straight fixed path;

drive means for moving said ram forward along said path in a working stroke followed by rearward movement of said ram along said path in a return stroke, said drive means including a continuously rotating main shaft;

a die set for transforming said cups into said can bodies as said cups are driven through said die set by said ram during said working stroke;

apparatus for applying compressed air through said ram into said can bodies to strip said can bodies from said ram while the latter begins said return stroke;

said apparatus including a rotary valve for controlling application of said compressed air through said ram into said can bodies;

said rotary valve including a valve shaft and a rotor mounted on said valve shaft for rotation therewith;

said valve shaft being rotated continuously at uniform speed within each revolution thereof; and said valve shaft being operatively connected with said main shaft for operation of said valve in coordination with movement of said ram;

for each revolution of said rotor, said ram operating through a cycle comprising said working and return strokes;

said valve also including an inlet port and an outlet port;

said rotor including a passage which, during a predetermined portion of each revolution for said rotor, is operatively positioned to connect said inlet port to said outlet port whereby compressed air applied to said inlet port appears at said outlet port;

said rotor including first and second elements mounted on said valve shaft for relative adjusting movement between said first and second element to adjust duration of said predetermined portion;

said rotor being adjustably positionable relative to said main shaft to adjust phasing between rotation of said rotor and movement of said ram by setting a location for said ram along said path at which compressed air is initially applied through said valve to said ram during each cycle thereof to strip a can body from said ram.

2. A bodymaker as defined in claim 1 in which each of said first and second elements is plate-like;

said elements being in parallel planes that are adjacent to each other and are perpendicular to said valve shaft;

said passage being defined by first and second apertures that extend through said first and second elements, respectively.

3. A bodymaker as defined in claim 2 in which each of said first and second apertures is shaped as an arc segment that is formed about said valve shaft as a center; and said apertures are operatively positioned to at least partially overlap one another.

4. A bodymaker as defined in claim 3 in which said first and second elements are constituted by respective first and second disks;

said valve shaft defining a rotational axis that extends through said disks at their respective centers; and said arc segments being equally spaced from said rotational axis.

5. A bodymaker as defined in claim 4 in which said rotary valve also includes a housing having said inlet and outlet ports;

said valve shaft being rotatably supported on said housing; and said housing enclosing a majority of said rotor with edge portions of said rotor extending outside of said housing whereby said first and second elements are accessible from outside of said housing for relative adjusting movement between said elements to adjust said duration of said predetermined portion of each revolution for said rotor.

6. A bodymaker as defined in claim 1 also including a stationary frame on which said ram is supported for said horizontal longitudinal movement;

said rotary valve also including a housing on which said shaft is rotatably supported;

said housing being fixedly secured on said frame;

a timing belt interposed between said main shaft and said valve shaft and through which power is transmitted to drive said valve shaft and coordinate operation between said valve shaft and said ram.

7. A rotary valve for controlling duration for application of compressed air to a mechanical machine section which is operated continuously and cyclically by a drive means that also provides power to drive a rotor of said valve continuously at uniform speed throughout a valve cycle that is equal in time to a cycle of said machine section, said valve cycle being equal in time to a complete revolution of said rotor, said rotary valve also including:

a shaft rotated continuously by said drive means and a rotor mounted on said shaft for rotation therewith;

an inlet port and an outlet port;

said rotor including a passage which, during a predetermined portion of each revolution for said rotor, is operatively positioned to connect said inlet port to said outlet port whereby compressed air applied to said inlet port appears at said outlet port;

said rotor including first and second elements mounted on said shaft for relative adjusting movement between said first and second elements to adjust duration of said predetermined portion.

8. A rotary valve as defined in claim 7 in which each of said first and second elements is plate-like;

said elements being in parallel planes that are adjacent to each other and are perpendicular to said shaft;

said passage being defined by first and second apertures that extend through said first and second elements, respectively.

9. A rotary valve as defined in claim 8 in which each of said first and second apertures is shaped as an arc segment that is formed about said shaft as a center; and said apertures are operatively positioned to at least partially overlap one another.

10. A rotary valve as defined in claim 9 in which said first and second elements are constituted by respective first and second disks;

said shaft defining a rotational axis that extends through said disks at their respective centers; and said arc segments being equally spaced from said rotational axis.

11. A rotary valve as defined in claim 10 also including a housing having said inlet and outlet ports;

said shaft being rotatably supported on said housing; and said housing enclosing a majority of said rotor, with edge portions of said rotor extending outside of said housing whereby said first and second elements are accessible from outside of said housing for relative adjusting movement between said elements to adjust said duration of said predetermined portion of each revolution for said rotor.

12. A rotary valve as defined in claim 10 in which said disks have essentially equal diameters; and said arc segments are essentially the same in size and shape.

13. A rotary valve as defined in claim 10 in which said rotor is adjustably positioned relative to said drive means to adjust phasing between said rotor and said machine section by setting a point during each cycle of operation for said machine section at which compressed air is initially applied thereto through said rotary valve.

14. A rotary valve:

including stationary inlet and outlet ports, a rotor interposed between said ports, a drive shaft on which said rotor is mounted and through which power is applied to rotate said rotor continuously;

said rotor comprising first and second elements mounted face-to-face, each of said elements having an aperture segment therethrough, with overlapping portions of said aperture segments cooperating to provide a passage connecting said ports together during a portion of each revolution of said rotor;

said elements being adjustable relative to one another by pivoting at least one of said elements relative to said shaft to adjust overlapping of said aperture segments and thereby establish duration for said portion of each revolution of said rotor;

said rotor being pivotally adjustable relative to said drive shaft to adjust phasing between rotation of said rotor and a device that is provided with compressed air that flows through said rotary valve.

* * * * *